United States Patent [19]

Haga et al.

[11] 4,416,580

[45] Nov. 22, 1983

[54] CLAW CRANE WITH PUSHERS

[75] Inventors: Yukio Haga; Tomeo Kai; Akira Shirayama; Gengi Kanatani, all of Fukuyama, Japan

[73] Assignee: Nippon Kokan Kabushiki Kaisha, Tokyo, Japan

[21] Appl. No.: 179,643

[22] Filed: Aug. 20, 1980

[30] Foreign Application Priority Data

Aug. 30, 1979 [JP] Japan ..... 54-109647

[51] Int. Cl.[3] ..... B66C 1/42

[52] U.S. Cl. ..... 414/626; 294/67 A

[58] Field of Search ..... 414/626, 619, 639, 640, 414/668, 667, 671; 294/67 A, 67 R, 67 AA, 67 AB, 67 BB, 67 BC; 212/11

[56] References Cited

U.S. PATENT DOCUMENTS

| | | | |
|---|---|---|---|
| 3,870,356 | 3/1975 | Meads | 294/67 A |
| 3,897,097 | 7/1975 | Davis, Jr. | 294/67 A |
| 3,971,478 | 7/1976 | Matasa | 294/67 A |

*Primary Examiner*—James B. Marbert

*Attorney, Agent, or Firm*—Fleit, Jacobson, Cohn & Price

[57] ABSTRACT

A claw crane well suited for loading and unloading, transporting and stacking steel products such as blooms, includes a mast suspended from the crane proper to be moved vertically, a beam tiltably attached to the lower end of the mast, and a plurality of load carrying claw shifters and load unloading pusher means which are movably arranged on the beam.

7 Claims, 13 Drawing Figures

CLAW CRANE WITH PUSHERS

BACKGROUND OF THE INVENTION

The present invention relates to claw cranes of the type having pushers, and more particularly the invention relates to such claw crane which is well suited for loading and unloading, transporting and stacking steel products such as blooms or the like.

The stacking of steel products (cast steel products) is frequently utilized for the purpose of transporting the products from one factory to another or temporarily storing the products within the factory. In this case, the stacking of such products has the following merits.

(1) The storage space area for steel products can be reduced, and moreover if freight cars, trailers or the like are used for transporting the products, their loaded weights can be increased with the resulting decrease in the number of the cars or trailers used.

(2) Where the rolled steel products (or cast steel products) are hot charged into the subsequent processing units, the stacking of the steel products (or the cast steel products) has the effect of preventing drop in the temperature of the products.

In the past, it has been the usual practice to use a crane with a lifting magnet for stacking high-temperature steel products (or cast steel products), and the problem with the use of such crane is that according to the presently available techniques the attraction of such magnet is such that it is possible to lift only those products whose temperatures are lower than 600° C. As a result, a method has recently been investigated in which the surface portion of steel product (or cast steel) tending to contact with the magnet is locally cooled to below 600° C. so as to be lifted by the lifting magnet equipped crane, and this method has not come into use due to the anticipated danger of the steel product (or the cast steel) falling due to the regenerated heat, causing camber, bending or the like in the product due to the localized cooling and so on.

On the other hand, it is conceivable to use a crane of the tongs type for the stacking purposes. However, this method is also disadvantageous in that since the steel products (or the cast steel products) are lifted one at a time, the resulting crane cycle time is longer than the other cranes with the resulting decrease in transport efficiency, and moreover the spacing equal to the tongs width will be left between the stacked steel products thus inevitably decreasing the temperature of the products and also decreasing the loaded weight. Of course, it is conceivable to simultaneously lift a plurality of the products by the tongs. In this case, however, there is a great danger of the products falling and thus it is absolutely impossible to use this method.

Still another known stacking method uses a claw crane and this method is disadvantageous in that while there is no ill effect due to the product temperature, a distance member must be inserted between the steel products (or the cast steel products) to provide a claw withdrawing allowance with the resulting deterioration of the operation efficiency, and moreover the presence of spaces for distance member insertion allowance inevitably results in a considerable heat release and thus undesirable from the standpoints of slow cooling of the steel products and saving of energy.

SUMMARY OF THE INVENTION

The present invention has been made with a view to overcoming the foregoing deficiencies in the prior art, and it is the object of the invention to provide a claw crane capable of efficiently and stably stacking as many steel products as possible within the same space when transporting the steel products or temporarily storing the steel products in a cooling space or the like.

In accordance with the present invention there is thus provided a pusher equipped claw crane comprising a mast vertically movably suspended from a crane hoist, a main beam pivotably mounted on the lower end of the mast, a plurality of sub-beams attached to the lower part of the main beam to cross it at right angles, a plurality of claw shifters and pusher means which are alternately suspended from the lower part of the sub-means so as to be movable in the axial direction thereof, and a tilting unit fixed in place on the central or intermediate part of the mast so as to tiltably support the sub-beams. The plurality of sub-beams are comprised of right and left groups each forming three pairs of guide rails and arranged symmetrically on the end sides of the main beam at predetermined positions on the lower surface thereof, whereby the claw shifter is suspended from each of the two of each three guide rail pairs which are arranged on both sides and the pusher means is suspended from the pair of guide rails arranged between the side pairs.

DESCRIPTION OF THE PREFERRED EMBODIMENTS

Figure 1:
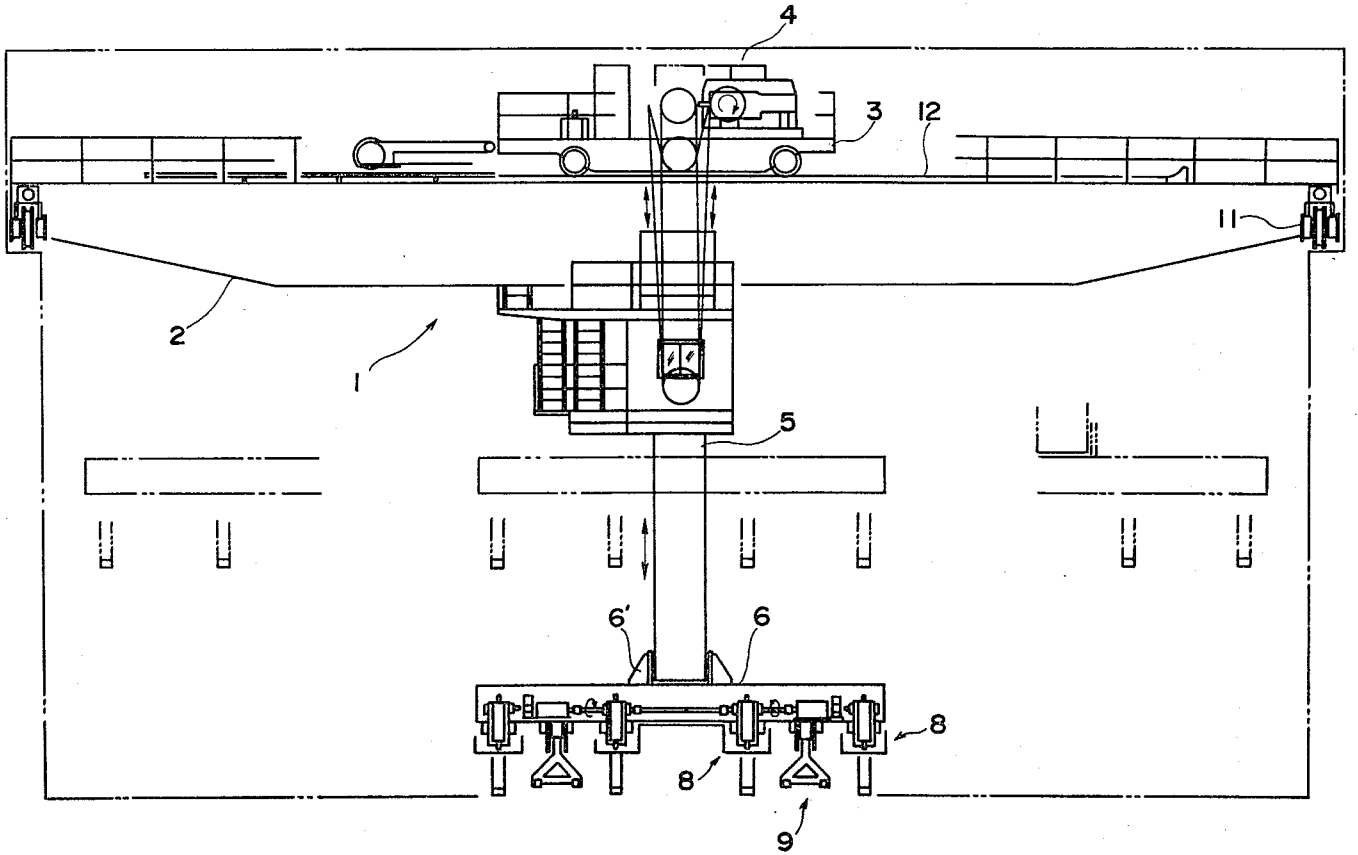
FIG. 1 is a schematic front view showing an embodiment of the present invention.

The present invention will now be described in greater detail with reference to the accompanying drawings.

Referring to FIGS. 1 to 7, numeral 1 designates a claw crane according to the present invention, which comprises a crane proper 2 which is movable in the longitudinal direction, a mast 5 vertically movably suspended from a hoist 4 on a traveller 3 arranged on the crane proper 2 so as to be moved traversely, a main beam 6 pivotably attached to the lower end of the mast 5, a plurality of sub-beams 7 comprising right and left groups each forming three pairs of guide rails and arranged symmetrically on the main beam 6 at predetermined positions on its lower surface to cross it at right angles, a claw shifter 8 axially slidably suspended from each of the right and left pairs of guide rails 7' of each three guide rail pairs, a pusher means 9 axially slidably suspended from the middle pair of guide rails 7'' between the right and left pairs of guide rails 7', and a tilting unit 10 mounted on the mast 5 at a predetermined intermediate position so as to support the sub-beams 7 to be tiltable relative to the mast 5.

The crane proper 2 is provided at its ends with travelling wheels 11 so as to travel in the longitudinal direction along the rails which are not shown and it is also provided on its upper surface with traverse rails 12 on which the traveller 3 having the hoist 4 mounted thereon is traversely movably arranged. Although not shown, the crane proper 2 is equipped with a hoisting motor, a traverse motor, a travelling motor and a control panel.

Numeral 13 designates a mast holding guide mast of the box type which is arranged to traverse, together with the traveller 3, along the crane lower surface, and it is provided in the central portion with a guide rail 14 such that guide rollers 15 provided on the mast 5 are guided along the guide rail 14, thus making it possible to vertically move the mast 5 through the operation of the hoist 4.

The main beam 6 includes on its central upper surface portion a coupling member 6' which is pivotably attached to the lower end of the mast 5 by a pin 16.

Numeral 17 designates a claw shifter feed screw arranged at a predetermined position below and between each pair of guide rail sub-beams 7' so as to extend parallel to the sub-beam 7', and 18 a pusher feed screw arranged at a predetermined position below and between each pair of guide rail sub-beams 7'' so as to extend parallel to the sub-beams 7''.

Figure 3:
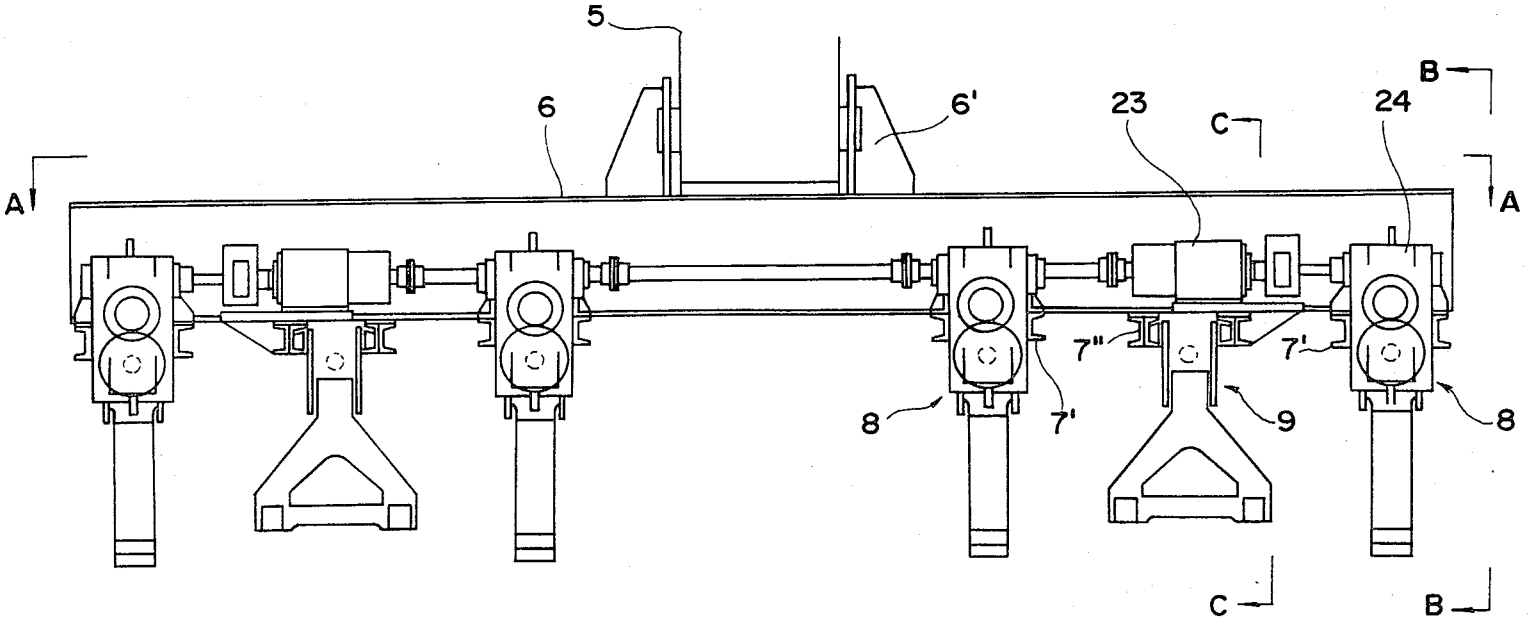
FIG. 3 is a partial enlarged view of FIG. 1.
Figure 5:
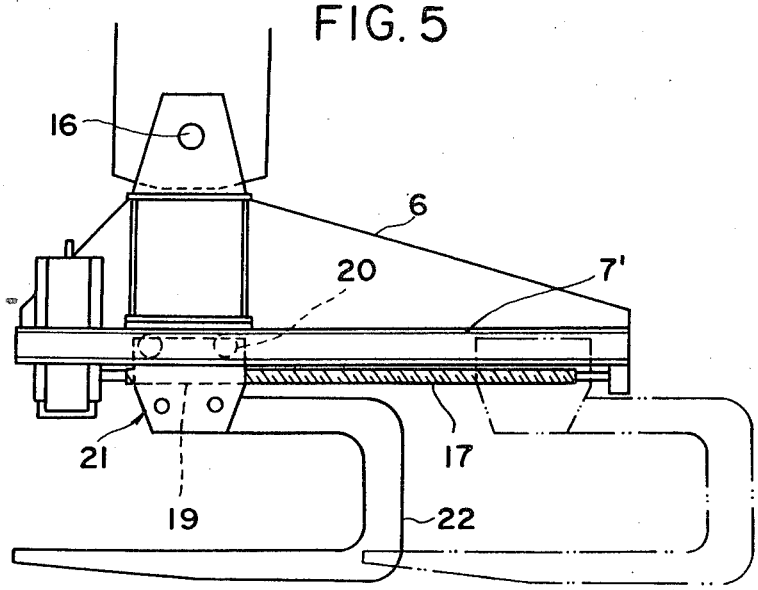

As shown in FIGS. 3 and 5, each of the claw shifters 8 comprises a shifter proper 21 having at its center a nut 19 which is threadedly engaged with the feed screw 17 and on its sides guide rolls 20 which are slidably engaged with the guide rails 7' and a claw 22 attached to the lower surface of the shifter proper 21, and the adjacent two of the feed screws 17 are turned by a shift motor 23 mounted on the end-side upper surface of the sub-beams 7 and reduction gears 24 which are coupled to the shift motor 23 and each mounted on the end-side surface of the sub-beams 7 so as to move the nuts 19 and thereby to shift the claws 22 in the longitudinal direction.

Figure 4:
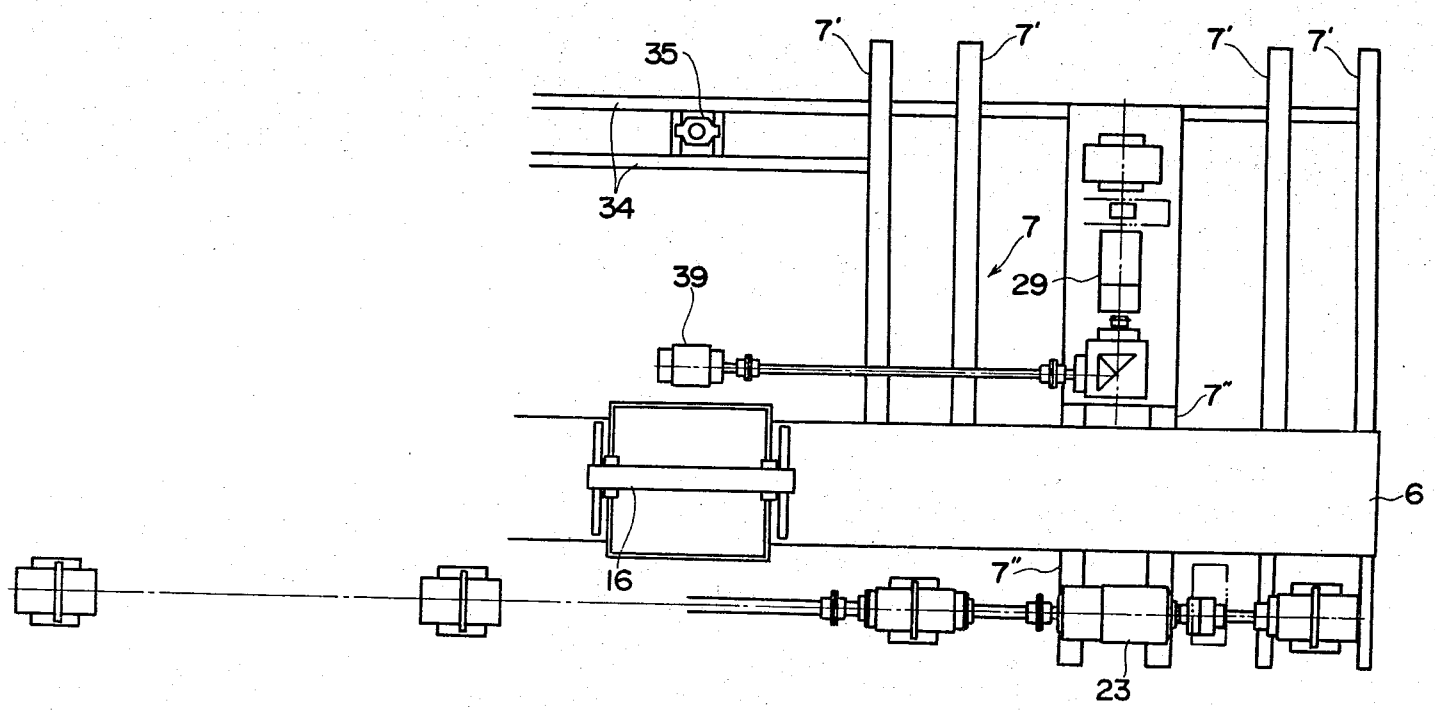
FIGS. 4, 5 and 6 are views as looked respectively in the direction of arrowed lines A—A, B—B and C—C in FIG. 3.
Figure 6:
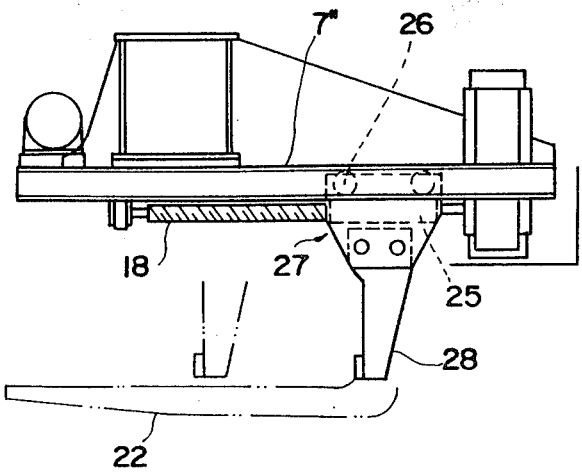

As shown in FIGS. 3 and 6, each of the pusher means 9 comprises a pusher proper 27 having at its center a nut 25 threadedly engaged with the feed screw 18 and on its sides guide rolls 26 which are slidably engaged with the guide rails 7'' and a pusher 28 fixed to the lower surface of the pusher proper 27, and the feed screw 18 is turned by a pusher motor 29 placed in a predetermined position on the sub-beams 7 so as to move the nut 26 and thereby to move the pusher 28 in the longitudinal direction. As shown in FIG. 4, each motor 29 is connected through an electromagnetic clutch 39 to a selector switch which is not shown so as to be operated collectively or separately. In the present embodiment, as shown in the figure, the pushers 28 are shorter in length than the claws 22 so that the steel products inserted into the claws 22 can be pushed in the longitudinal direction by the pushers 28.

Figure 2:
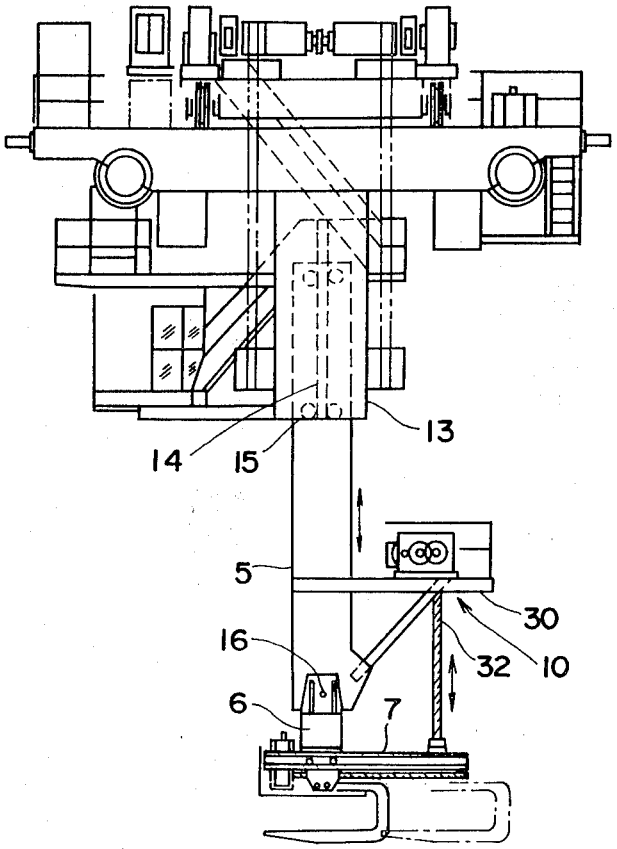
FIG. 2 is a side view of FIG. 1.
Figure 7B:
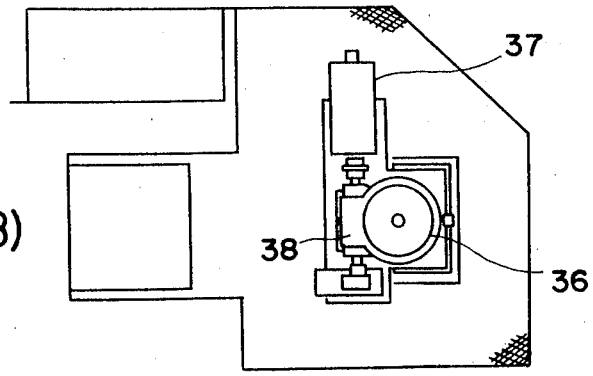
FIG. 7 is an enlarged view of a tilting unit, in which (A) is a front view and (B) is a top view.
Figure 7A:
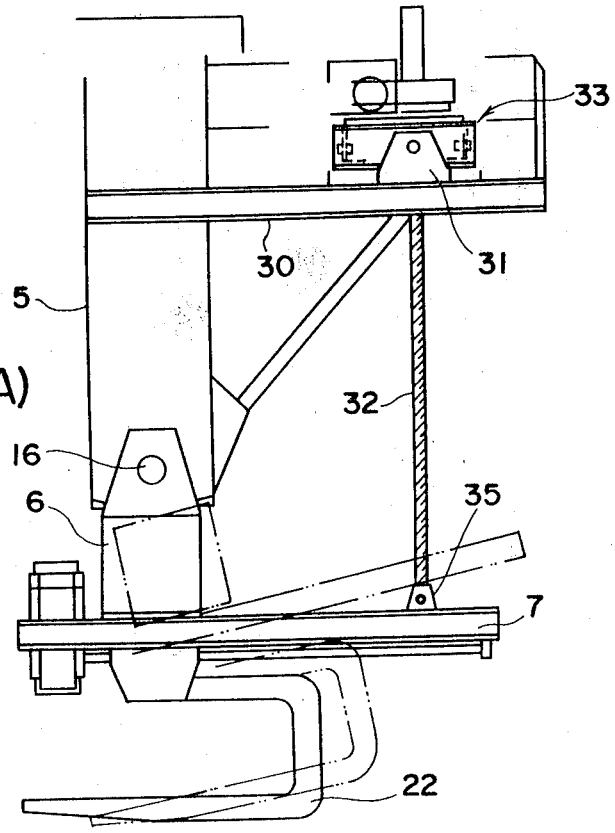
Figure 8A:
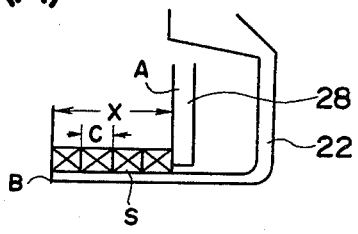
FIGS. 8 (A), (B), (C) and (D) illustrate a plurality of schematic views useful for explaining the loading and unloading operations according to the apparatus of this invention.

The tilting unit 10 is provided for the purpose of ensuring smooth unloading of steel products, and as shown in FIGS. 2 and 7 the tilting unit 10 comprises a base plate 30 extended from a predetermined intermediate position on the mast 5 and a tilting unit proper 33 rotatably supported on the base plate 30 by a supporting member 31 and including a vertically movable feed screw 32, and the lower end of the feed screw 32 is pivotably connected to a coupling 35 provided on spacing holding connecting members 34 in the central portion on one end-side of the sub-beams 7 so that the sub-beams 7 are supported so as to be tiltable about the pin 16 pivotably connecting the mast 5 and the main beam 6 in response to the vertical movement of the feed screw 32. In this case, the mechanism for vertically moving the feed screw 32 includes a worm wheel 36 through the center of which the feed screw 32 extends for threadedly engaging therewith a tilting motor 37 and a worm 38, whereby the rotation of the tilting motor 37 is transmitted through the worm 38 to the worm wheel 36 whose rotation in turn moves the feed screw 32 so as to hold the sub-beams 7, along with the Claws 22, in a tilted position of a desired angle.

An exemplary method of using the claw crane of this invention and its function will now be described. In the first place, the red-hot steel products on the gathering table which is not shown are gathered in an orderly manner at a desired place by the pusher car which is not shown and then the loading and unloading of the steel products is accomplished by the pusher equipped claw crane of this invention according to the following sequence of operations.

(1) Firstly the rate capacity of the claws 22 for loading the red-hot steel products such as blooms is supplied to and stored in a computing unit (not shown) and then an actual loading capacity corresponding to the rated loading capacity is computed by the computing unit.

In accordance with a requisite condition that the rated loading capacity $\geqq$ the actual loading capacity, the computing unit computes the number of red-hot steel products that can be loaded on the claws 22 and the result is indicated on the display unit which is not shown.

(2) In accordance with the loading capacity determined by the step (1), that is, the number of red-hot steel products that can be inserted into the claws 22 (the number is 4 in the case of FIG. 8), the pusher means 9 are moved and positioned such that the distance X between the forward end A of the pushers 28 and the forward end B of the claws 22 becomes $X=4C$ (where C is the width of the steel products) as shown in FIG. 8 (A). In this case, the positioning of the pushers 28 is accomplished by the operator, that is, while looking at the indication from the computing unit a product number selector switch (not shown) is operated and the pusher motors 29 are operated in response to the output of the selector switch. Alternatively, the positioning of the pushers can be accomplished by directly applying the output (the number of products) of the computing unit to the pusher motors 29 to operate them.

(3) The tilting unit 10 is operated such that the main beam 6 is held in a horizontal position and the claws 22 are positioned horizontally.

(4) The claws 22 are placed below the red-hot steel products through the operation of the crane proper 2.

(5) The main beam 6 is lifted through the operation of the hoist 4 of the crane proper 2.

(6) The red-hot steel products are transported to a desired stacking position through the operation of the crane proper 2.

(7) The hoist 4 of the crane proper 2 is operated such that both the mast 5 and the main beam 6 are lowered and the red-hot steel products loaded on the claws 22 are adjusted to the height of the unloading space.

(8) The tilting unit 10 is operated so that the sub-beams 7 are tilted so as to facilitate slipping down of the red-hot steel products to the unloading space.

(9) The red-hot steel products are pressed against a support 40 at the unloading space. In this condition, the claw shifters 8 are operated (but the pushers are held stationary) so that only the claws 22 are retreated relative to the support 40 as shown in FIG. 8 (B) and the red-hot steel products on the claws 22 are caused to slip down to the unloading space as if they were pushed forward by the pushers 28. During this unloading operation, the pusher means 9 are usually not operated. However, where it is desired to increase the operation efficiency or where it is necessary to effect for example the posture adjustment of the steel products remaining on the claws 22, the pusher means 9 are operated suitably to effect the unloading.

(10) If the posture of the red-hot steel products which were unloaded to the unloading space is not proper, the claw shifters 8 are operated such that the steel products are pushed by the forward ends of the claws 22 and their posture is adjusted.

The above-mentioned operation steps complete one cycle of the unloading operation, and by handling red-hot steel products in the similar manner as indicated in FIG. 8, (C) and (D) it is possible to successively stack the red-hot steel products safely and positively with high efficiency and high stacking density.

Of course, where red-hot steel products are short in length, it is possible to decouple the electromagnetic clutch 39 in the claw and pusher drive system so as to use only one or the other of the two units, that is, only the two claw shifters 8 and the single pusher means 9 and thereby to stack the steel products.

Figure 9:
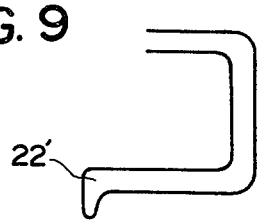
FIG. 9 is a partial schematic view showing a modified form of the claw.
Figure 8B:
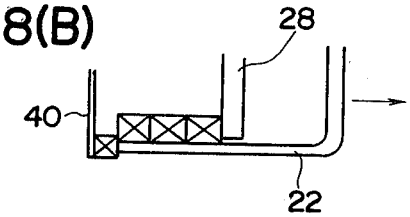
Figure 8C:
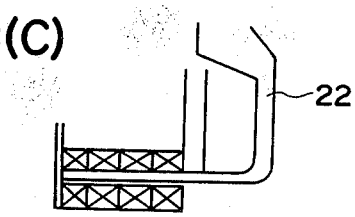
Figure 8D:
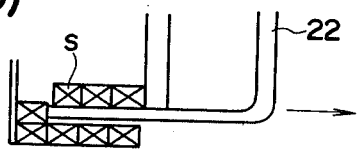

The shape of the claws used with the present invention is not intended to be limited to the one shown in FIG. 5. For instance, the claw 22 may be formed as shown in FIG. 9 so that its forward end face 22' has a large contact area so as to facilitate the posture adjustment of steel products.

It will thus be seen from the foregoing description that by virtue of the fact that the pusher equipped claw crane of this invention includes loaded objects transporting claw shifters and loaded objects unloading pusher means and the shifters and the pusher means are slidably arranged on a beam attached to the lower end of a mast which is vertically movably suspended from a crane proper, there is an advantage that both the transportation of objects to be carried, such as, red-hot steel products to any desired stacking position and the stacking of a greater number of objects in the same space at the stacking position can be accomplished stably with high efficiency and high stacking density. Further, by virtue of the fact that the claw crane includes a beam tilting unit adapted to tilt the claws as desired, the claw crane of this invention is capable of continuously and efficiently unloading the objects loaded on the claws at a desired position and stacking the objects with high stacking efficiency and thus it has a very great utility value as a claw crane for loading, unloading and transporting steel blooms or the like.

We claim:

1. A pusher equipped claw crane comprising:

a mast suspended from crane hoist means so as to be moved vertically;

a main beam pivotably coupled to the lower end of said mast;

a plurality of sub-beams arranged on the lower part of said main beam to cross the same at right angles;

a plurality of claw shifter means suspended from the lower part of two of said sub-beams to be moved in the axial direction thereof;

pusher means arranged between two adjacent claw shifter means and suspended from the lower part of one of said sub-beams to be moved in the axial direction thereof;

means for moving said claw shifter means and for moving said pusher means with respect to said sub-beams; and tilting means attached to an intermediate part of said mast for controlling tilting movement of said sub-beams.

2. A claw crane according to claim 1, wherein said plurality of sub-beams are comprised of right and left groups each forming three pairs of guide rails and arranged symmetrically at predetermined positions on the lower surface of the end sides of said main beam, and wherein each of said claw shifter means is suspended from one of the right and one of the left side pairs of each said three pairs of guide rails and a pusher means is suspended from the pair of guide rails positioned between said right and left pairs of each said three pairs of guide rails.

3. A claw crane according to claim 2, wherein each of said claw shifter means comprises a shifter means proper including central nut means and a plurality of guide rolls arranged on each side of said shifter means proper to slidably engage with one of said pair of guide rails, and a claw attached to the lower surface of said shifter means proper, and wherein said nut means is threadedly engaged with a claw shifter feed screw arranged at a position below and between said pair of guide rails to extend parallel thereto.

4. A claw crane according to claim 2, wherein each of said pusher means comprises a pusher means proper including central nut means and a plurality of guide rolls arranged on each side of said pusher means proper so as to slidably engage with one of said pair of guide rails, and a pusher attached to the lower surface of said pusher means proper, and wherein said nut means is threadedly engaged with a pusher feed screw arranged at a position below and between said pair of guide rails to extend parallel thereto.

5. A claw crane according to claim 2, wherein said tilting means comprises a base plate attached to the intermediate part of said mast so as to overhang therefrom, and a tilting means proper rotatably mounted on said base plate through the intermediary of bearing means and including a vertically movable feed screw, and wherein the lower end of said feed screw is pivotably attached to coupling means positioned in a central part of said crane proper on one end side of said guide rails.

6. A claw crane according to claim 1, wherein said mast is vertically oriented and has an upper portion thereof guided for vertical movement only.

7. A pusher equipped claw crane comprising:

a main support frame movable in a longitudinal direction;

guide means on said support frame extending transversely to the longitudinal direction;

a traveler guided for movement along said guide means;

a mast supported by said traveler, said traveler including means for guiding movement of said mast in a vertical direction and for constraining the mast to move in only the vertical direction;

a main beam pivotably coupled to the lower end of said mast;

a plurality of sub-beams arranged on the lower part of said main beam to cross the same at right angles;

a plurality of claw shifter means and pusher means alternately arranged each so as to be suspended from the lower part of two of said sub-beams and to be moved in the axial direction thereof; and tilting means attached to an intermediate part of said mast for controlling tilting movement of said sub-beams.

* * * * *